US009324519B2

(12) United States Patent
Karlen

(10) Patent No.: US 9,324,519 B2
(45) Date of Patent: Apr. 26, 2016

(54) SWITCHING DEVICE

(75) Inventor: David Karlen, Vasteras (SE)

(73) Assignee: ABB Technology Ltd, Zurich (CH)

( * ) Notice: Subject to any disclaimer, the term of this patent is extended or adjusted under 35 U.S.C. 154(b) by 0 days.

(21) Appl. No.: 14/401,469

(22) PCT Filed: May 30, 2012

(86) PCT No.: PCT/EP2012/060129

§ 371 (c)(1),
(2), (4) Date: Nov. 14, 2014

(87) PCT Pub. No.: WO2013/178257

PCT Pub. Date: Dec. 5, 2013

(65) Prior Publication Data

US 2015/0262774 A1 Sep. 17, 2015

(51) Int. Cl.
*H01H 33/10* (2006.01)
*H01H 9/36* (2006.01)

(52) U.S. Cl.
CPC ..... *H01H 33/10* (2013.01); *H01H 9/362* (2013.01)

(58) Field of Classification Search
CPC ..... H01H 9/362; H01H 2009/365; H01H 2009/367; H01H 33/08; H01H 2033/085
USPC ..... 218/15, 30, 31, 34, 46, 105, 149, 156
See application file for complete search history.

(56) References Cited

U.S. PATENT DOCUMENTS 2,468,422 A * 4/1949 Wood ..... 218/149
2003/0000925 A1* 1/2003 Azzola et al. ..... 218/153
2003/0090185 A1 5/2003 Abroy
2005/0263492 A1* 12/2005 McCoy ..... 218/34
2006/0086693 A1 4/2006 Yeon
2013/0075367 A1* 3/2013 Eriksson et al. ..... 218/34

FOREIGN PATENT DOCUMENTS

CN 1770351 A 5/2006
CN 201918286 U 8/2011

(Continued)

OTHER PUBLICATIONS

International Preliminary Report on Patentability Application No. PCT/EP2012/060129 Completed: May 23, 2014 12 pages.

(Continued)

*Primary Examiner* — Renee Luebke
*Assistant Examiner* — William Bolton
(74) *Attorney, Agent, or Firm* — Whitmyer IP Group LLC

(57) ABSTRACT

A low-voltage switching device including a plurality of arc-extinguishing chambers, wherein each of the arc-extinguishing chambers encloses a contacting unit including a stationary contact and a movable contact and arcs are formed when the movable contact is disconnected to the stationary contact, each of the arc-extinguishing chamber including a plurality of U-shaped arc extinguishing plates arranged for splitting, guiding and cooling the arc formed between the contacts and sidewalls provided with guiding means for guiding the arms of the arc extinguishing plates. The guiding means includes a plurality of supporting plates and the supporting plates are arranged protruding towards interior of the arc-extinguishing chamber for receiving the arms of the arc-extinguishing plates and for providing electrical isolation between arms of two adjacent arc extinguishing plates.

3 Claims, 3 Drawing Sheets

(56) References Cited

FOREIGN PATENT DOCUMENTS

| | | | |
|---|---|---|---|
| DE | 1005592 | B | 4/1957 |
| DE | 102010032715 | A1 | 2/2012 |
| EP | 1103996 | A1 | 5/2001 |

OTHER PUBLICATIONS

International Search Report and Written Opinion of the International Searching Authority Application No. PCT/EP2012/060129 Completed: Feb. 11, 2013; Mailing Date: Feb. 18, 2013 9 pages.

* cited by examiner

SWITCHING DEVICE

FIELD OF THE INVENTION

The present invention relates to a low-voltage switching device for switching electric power. More particularly, it relates to a low-voltage switching device including an arc extinguishing chamber enclosing a contacting unit, wherein the contacting unit comprises a stationary and a movable contact and the arc extinguishing chambers is adapted for extinguishing arcs formed between the contacts during disconnection of the contacts. The range of the low-voltage is up to 1000 V AC and 1500 V DC.

BACKGROUND OF THE INVENTION

A low-voltage switching device includes a contacting unit including a stationary contact and a movable contact movable between a rest position and a working position, wherein arcs are formed between the contacts when disconnection of the contacts, that means when the movable contact is disconnected from the stationary contact. To extinguish the arcs, an arc-extinguishing chamber is provided and arranged to enclose the contacting unit. The arc-extinguishing chamber may have a plurality of U-shaped arc extinguishing plates arranged for splitting, guiding and cooling the arc formed between the contacts. To improve the breaking/disconnection capacity of the switching device, the arc-extinguishing chamber must provide an effectively attraction of an arising arc from the contact surfaces into the arc extinction chamber. When an arc is attracted into the arc-extinguishing chamber, it is further divided into several shorter arcs by the arc-extinguishing plates, which increases the voltage drop over the separated contacts and consequently breaks the electrical current. To attract the arc into the arc-distinguishing chamber, a force is needed to act on the arc. In order to achieve this force, the arms of U-shaped arc extinguishing plates is arranged to affect the magnetic field created by the arc so that the force acting on the arc increase. It is desirable that the arc will be attracted straightly into the arc-extinguishing chamber to prevent re-ignition directly between the contacts. At the meanwhile, it is desired that the arcs will not damage the arms, which drastically decrease the breaking capacity.

An EP patent EP 1 103 996 B1 discloses a switching device having a bridge of two movable contacts with corresponding arc extinguishing plates and guidance means provided for receiving and guiding arms/ends of the arc extinguishing plates. These guidance means are also capable of insulating the arc extinguishing plates from the movable contacts and of reinforcing the side wall of the switching device.

SUMMARY OF THE INVENTION

The object of the present invention is to provide a low-voltage switching device capable of guiding arc-extinguishing plates into an arc-extinguishing chamber and preventing the arms of the arc-extinguishing plates from damage caused by arcs.

These objects are achieved by a low-voltage switching device. The low-voltage switching device is further characterized in that the guiding means comprises a plurality of supporting plates. The supporting plates are arranged protruding towards interior of the arc-extinguishing chamber for receiving the arms of the arc-extinguishing plates and for providing electrical isolation between arms of two adjacent arc extinguishing plates. In this way, the arms of each of the arc-extinguishing plates are isolated from each other and the arc is prevented from standing between the arms. This reduces the risk of re-ignition and damage of the arms.

It is advantageous that the supporting plates are arranged on the sidewalls since the free space between the arms of the arc-extinguishing plates and the contacts makes it possible that the arms of the arc-extinguishing plates may be arranged closer to the contacts. Therefore, forces on the arcs are increased so that the arcs are distinguished efficiently.

A further advantage is that it makes possible to have a relative wider arms of the arc-extinguishing plates, which attracts the arcs more efficiently so that the arcs move to the arc-extinguishing chamber directly and quickly.

Consequently, the invention provides a higher breaking capacity in particular in the range of 690-1000V.

According to one embodiment of the invention, each of the supporting plates is longer and wider than the ones of each of the arms of an arc-distinguishing plate in order to provide an effective electrical isolation between the arms of arc-distinguishing plates.

According to one embodiment of the invention, the low-voltage switching device further comprises a base part and an arc-extinguishing chamber is detachably mounted to the base part. One advantage with a detachably mountable arc-extinguishing chamber is that separation of manufacturing of the base part and the chambers. Therefore, an arc-extinguishing chamber may be produced as modular, which may further reduce the manufacturing cost of a low-voltage switching device.

Alternatively, an arc-extinguishing chamber is moulded on the base part, in this way the sidewalls are further strengthened by the integrated arc-extinguishing chamber.

BRIEF DESCRIPTION OF THE DRAWINGS

The invention will now be explained more closely by the description of different embodiments of the invention and with reference to the appended figures.

DETAILED DESCRIPTION OF THE INVENTION

Figure 1A:
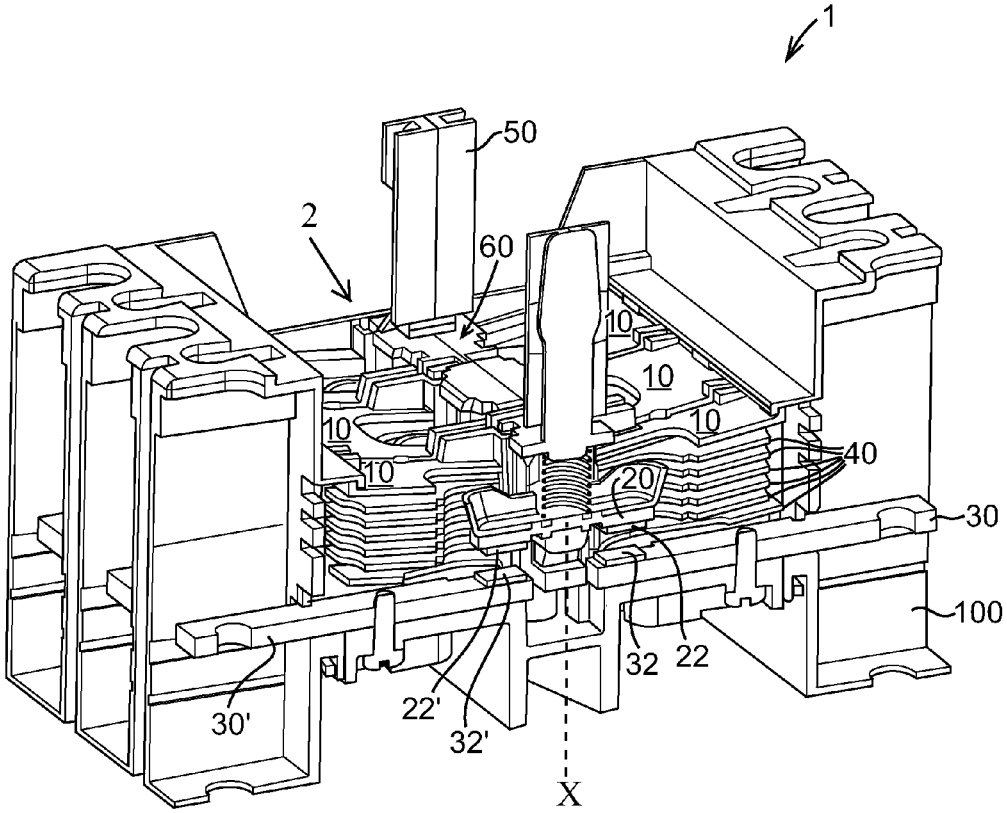
FIG. 1*a* is illustrates a partial cross-sectional view of a switching device including an arc-extinguishing chamber of the present invention, according to an embodiment of the invention.
Figure 1B:
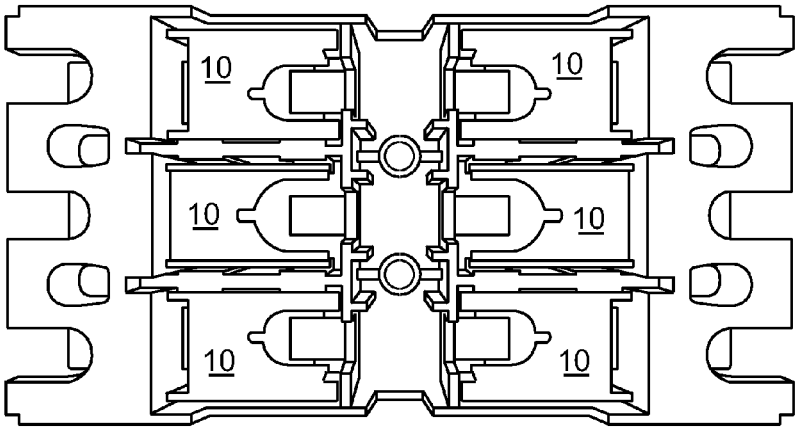
FIG. 1*b* is a horizontal cross sectional view of the switching device illustrated in FIG. 1*a*.

FIGS. 1*a* and 1*b* show a contactor 1 including a switching device 2 and a base part 100. The switching device 2 further comprises a plurality of arc-extinguishing chambers 10, a contacting unit 60 including a stationary contact member 30 and a movable contact member 20 and a contact carrier 50 connected to an actuating unit (not shown in the Figures).

In this example, the contactor is a three pole contactor with three contacting units to be connected to each of the three phases of a three-phase electric load. Each of the three contacting units includes a movable contact member 20 including two contact pads 22, 22' and two stationary contact members 30, 30' situated on the base part 100. The two stationary contact members 30, 30' are situated in align with the movable contact member 20. The contact pads 22, 22' are sited at each end of the movable contact member 20. Each of the stationary contact members 30, 30' is provided with a contact pad 32, 32' arranged to be cooperated with the contact pad 22, 22' of movable contact member 20 respectively.

The movable contact member is operated by the actuating unit via the contact carrier 50 and movable between a working position and a rest position, in this example, along X direction. At the working position, an electrical connection is made when the contact pads 22 and 32 are in contact to each other.

The arc-extinguishing chamber 10 encloses contact members 20, 30 when they are in contact to each other.

Figure 2A:
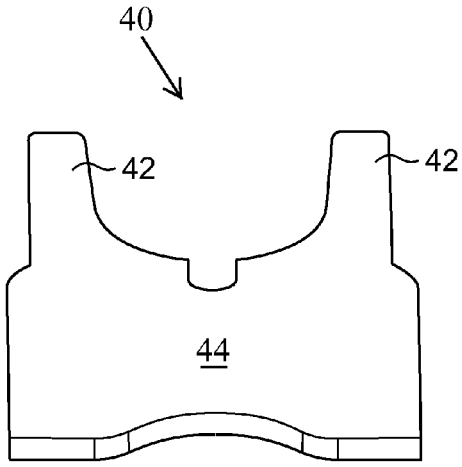
FIG. 2*a* shows an arc-distinguishing plate to be received by guiding means provided on the sidewall of the chamber in FIG. 1.
Figure 2B:
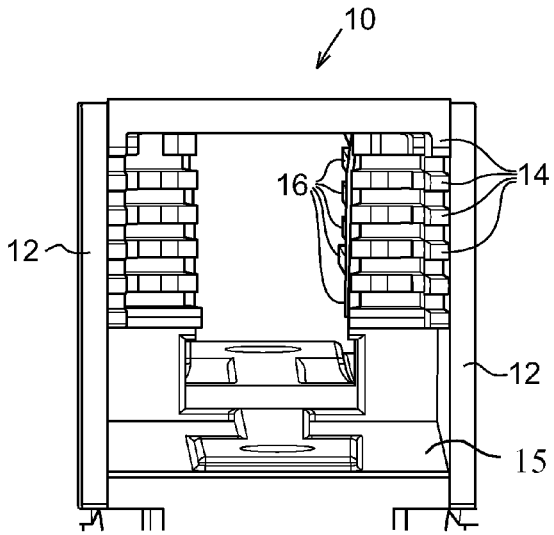
FIG. 2*b* is a partial cross sectional view of an arc-distinguishing chamber illustrated in FIG. 1.
Figure 2C:
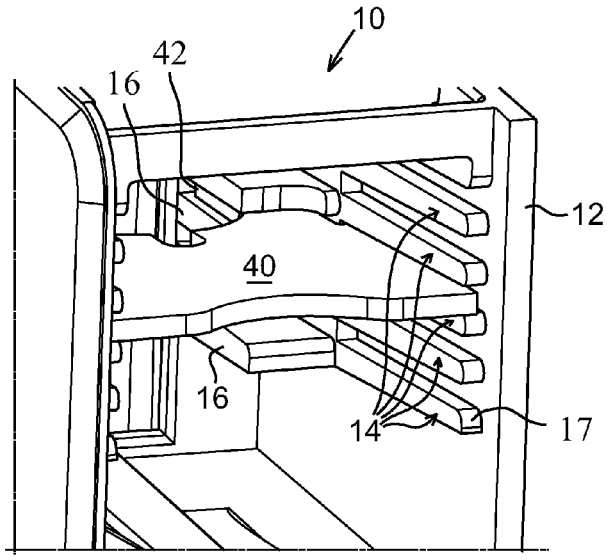
FIG. 2*c* shows a partial isometric view of the arc-distinguishing chamber illustrated in FIG. 2*b* with the arc-distinguishing plate placed on a supporting plate of the guiding means.

With reference to FIGS. 2*a*, 2*b* and 2*c*, a U-shaped arc-distinguishing plate 40 includes two arms 42 and a body 44. The arc-extinguishing chamber 10 comprises two sidewalls 12, a base wall 15. Sidewalls 12 of the arc-extinguishing chambers 10 are provided with guiding means 14. The guiding means 14 are further provided with a plurality of holding pins 17 protruded towards interior of the chamber and molded on the sidewalls and are arranged for facilitating insertions of the arc-extinguishing plates 40 during installation and maintaining the arc-extinguishing plates 40 in the positions during operation.

A plurality of U-shaped arc extinguishing plates 40 are provided in the chamber 10 arranged for splitting, guiding and cooling the arc caused when the movable contact member 20 is moved away from the stationary contact member 30. The U-shaped arc-extinguishing plates 40 may be for example metal plates, i.e. ferromagnetic material or non-ferromagnetic plates. When the contact members 20, 30 are separated to each other, an arc is formed between the contact members 20, 30. The arc generates a magnetic field that induces an electrical current in the arc-distinguishing plates. The arms 42 are arranged with a distance to the stationary contact member and provided to affect the magnetic field so that the Lorentz force that acts on the arc increases. With the increased force, arc will be attracted into the chamber, wherein the plurality of U-shaped arc-extinguishing plates 40 are arranged to divide the arcs into several shorter arcs. Consequently, this accelerates the voltage drop over the contact pads 22, 32 upon the disconnection so as to break the electrical current. The arms 42 are arranged in a place with a distance to the stationary contact members 30, 30'.

Each of the holding pins 17 is further extended by a supporting plate 16 in the insertion direction of an arc-extinguishing plate. The supporting plate protruded towards interior of the arc-extinguishing chamber 10 is arranged for receiving the arms 42 of the arc-extinguishing plates 40. The supporting plates 16 provide isolation between the arms 42 of the arc-distinguishing plates 40. The supporting plates 16 may be optionally arranged in parallel to each other. Preferably, each of the supporting plates 16 is longer and wider than the ones of each of the arms 42 so that the area of the supporting plate 16 is slightly larger than the one of the arc-distinguishing plate 40 so as to prevent arcs from standing and enduring between two arms. With structure of the supporting plate a wider arm with more metal material is enabled. This further increases the attraction of the arcs. The U-shaped arc-distinguishing plates 40 are made of metal, for example, ferromagnetic material or non-ferromagnetic plates. The guiding means and sidewalls are made of an electrical insulation material. The chamber itself is made of electrical insulation materials, such as thermoplastic or thermosetting material.

Moreover, free spaces between the arms 42 of the arc-distinguishing plates and the contacts 30 makes it possible that the arms 42 may be situated closer to the contact 30, 20 upon disconnection so as to increase the forces on the arcs. Thus, the arcs are distinguished efficiently.

The arc-extinguishing chamber 10 may be molded on the base part 100. In the exemplary embodiment of FIGS. 1*a* and 1*b*, each of the two chambers arranged for each of the three phases may share the same sidewalls as well.

Figure 3A:
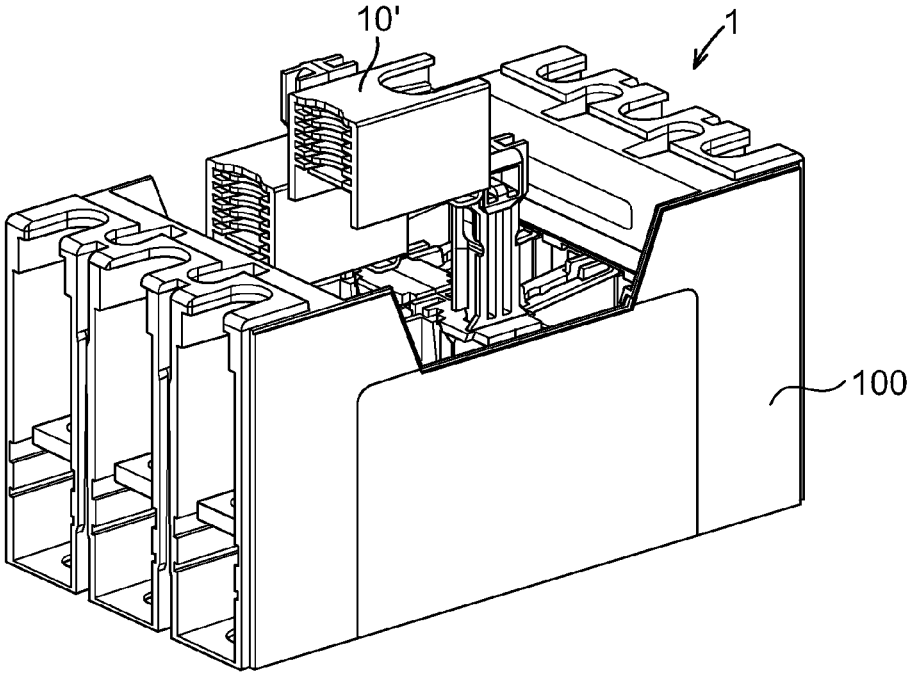
FIG. 3*a* illustrates a perspective view of an arc-extinguishing chamber to be detachably mounted the base part of the switching device, according to another embodiment of the invention.
Figure 3B:
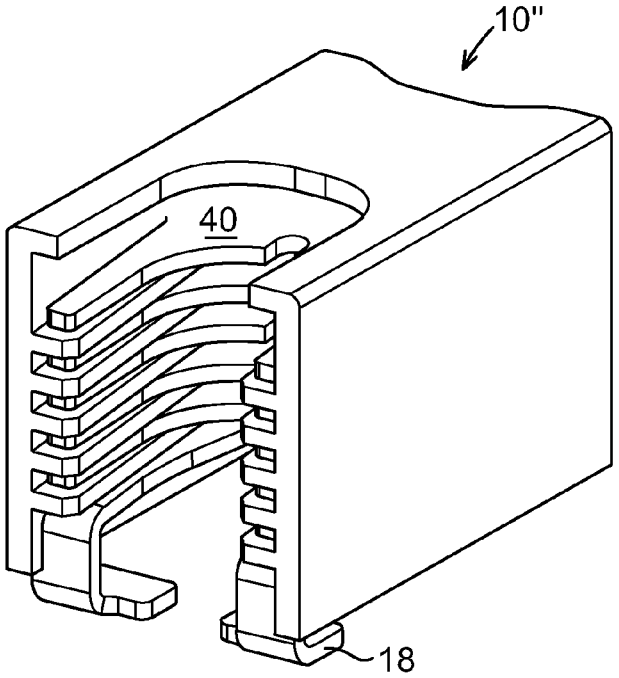
FIG. 3*b* illustrates a perspective view of an arc-extinguishing chamber molded to the base part of the switching device, according to yet another embodiment of the invention.

FIGS. 3*a* and 3*b* illustrate a perspective view of an arc-extinguishing chamber to be detachably mounted the base part of the switching device, according to another embodiment of the invention. In this exemplary embodiment, the arc-extinguishing chamber further comprises a connection member 18 to connect the chamber 10 to the stationary contact member 30.

The invention claimed is:

1. A low-voltage switching device comprising a plurality of arc-extinguishing chambers, wherein each of the arc-extinguishing chambers encloses a contacting unit including a stationary contact and a movable contact and arcs are formed when the movable contact is disconnected to the stationary contact, each of the arc-extinguishing chamber comprising a plurality of U-shaped arc-extinguishing plates arranged for splitting, guiding and cooling the arc formed between the contacts and sidewalls provided with guiding means for guiding the arms of the arc-extinguishing plates, wherein the guiding means comprises a plurality of supporting plates, characterized in that the supporting plates are arranged protruding towards interior of the arc-extinguishing chamber for receiving the arms of the arc-extinguishing plates and for providing electrical isolation between arms of two adjacent arc-extinguishing plates and, each of the supporting plates is longer and wider than each of the arms of an arc-distinguishing plate.

2. The low-voltage switching device according to claim 1, wherein the low-voltage switching device further comprises a base part and at least one of the arc-extinguishing chambers is detachably mounted to the base part.

3. The low-voltage switching device according to claim 1, wherein the low-voltage switching device further comprises a base part and at least one of the arc-extinguishing chambers is moulded on the base part.

* * * * *